US005441271A

United States Patent [19]

Briggs

[11] Patent Number: 5,441,271

[45] Date of Patent: Aug. 15, 1995

[54] GOLF SWING IMPROVEMENT DEVICE

[75] Inventor: Fred E. Briggs, Edmonton, Canada

[73] Assignee: F. E. Briggs & Company Innovations Ltd., Edmonton, Canada

[21] Appl. No.: 292,742

[22] Filed: Aug. 19, 1994

[30] Foreign Application Priority Data

Sep. 10, 1993 [CA] Canada ..... 2105960

[51] Int. Cl.[6] ..... A63B 69/36

[52] U.S. Cl. ..... 273/187.2; 273/191 B

[58] Field of Search ..... 273/187.2, 191 B, 186.2, 273/186.3

[56] References Cited

U.S. PATENT DOCUMENTS 4,582,325 4/1986 Yuhara ..... 273/187.2 X 5,150,901 9/1992 Stawicki ..... 273/187.2 X

*Primary Examiner*—George J. Marlo

*Attorney, Agent, or Firm*—George A. Seaby

[57] ABSTRACT

A golf swing improvement device includes a harness defined by shoulder straps and a chest strap for mounting the device on the user; and a multi-sectional rectilinear, extensible wand, which is connected to a plate on the front center of the chest strap and to the top end of a golf club by eyebolts. The structure enables the user to determine swing errors, because such errors result in contact of either arm of the user by the wand, depending upon the nature of the error.

10 Claims, 5 Drawing Sheets

GOLF SWING IMPROVEMENT DEVICE

BACKGROUND OF THE INVENTION

1. Field of the Invention

This invention relates to a golf swing improvement device.

In golf as in many other activities, one important key to success is to repeat an activity a sufficiently large number of times that the particular activity becomes automatic. This is the principle underlying most devices for helping a person to improve his or her golf swing. If a person can be caused to repeat a good golf swing a large number of times, e.g. several thousand times, the swing becomes automatic.

2. Discussions of the Prior Art

Because of the popularity of golf, many attempts have been made to assist neophytes and seasoned players to improve their swing. The results of such attempts are well documented in patent literature.

In this association, reference is made to Canadian Patent No. 708,502, issued to M. H. Austin et al; U.S. Pat. Nos. 2,103,502, issued to J. W. L. Webster on Dec. 28, 1937; 2,773,691, issued to F. E. Redfield on Dec. 11, 1956; 2,893,736, issued to J. M. Tesi on Jul. 7, 1959; 3,188,090, issued to L. E. Job on Jun. 8, 1965; 3,442,513, issued to G. F. Fisher on May 6, 1969; 3,595,583, issued to J. Oppenheimer on Jul. 27, 1971; 3,679,214, issued to J. D. Boyte, on Jul. 25, 1972; 4,399,994, issued to J. Hourihan, on Aug. 23, 1983; and 5,149,099 issued to D. L. Radakovich, on Sep. 22, 1992.

While the apparatuses described in the above listed patents differ in terms of complexity the underlying theme in each case is to cause a golfer to repeat a good swing until it becomes automatic.

At this point, it is worthwhile briefly describing a good golf swing (forget about putting, which is an art in itself). The following description is for a right-handed player. When setting up to strike a golf ball, the correct body posture is that the knees are slightly flexed to allow free movement of leg muscles. The feet are approximately shoulder width apart, and body weight is distributed evenly between both feet and should be concentrated at the balls of the feet. The upper torso is bent forward from the hips so that the arms hang freely from the shoulders. The club is gripped with the left hand uppermost on the club grip, and the thumb extending straight along the top of the club grip. The club grip should be under the pad at the bottom of the palm and along the base of the fingers where they meet the palm. The back of the left hand should face the target.

The right hand is below the left on the club grip with the little finger either overlapped or interlocked with the index finger of the left hand. Because the right hand is lower on the club, the right shoulder is lower by a like amount. The shoulders, hips and feet should be parallel or square to the target line. The right knee should be bent slightly inward so that the weight on the right foot is slightly toward the inside edge of the ball of the foot. The left foot should be turned toward the target 20°-30°.

The ball should be placed in line with the heel or instep of the left foot at a distance sufficient that the face of the club is directly behind the ball and perpendicular or square to the intended target line.

The club should be taken back from the ball in such a manner that the body revolves around a stationary spine. This calls for a one-piece takeaway which means simply that the ankles, knees, hips, shoulders and arms start to move simultaneously. Starting from the bottom, the left foot and ankle roll inwardly toward the ball position. The left knee moves inwardly until it is back to the ball position or slightly behind it. The hips rotate approximately 45°, the shoulders turn 90°, the arms rise to above shoulder level. When the club reaches about waist height, the wrists begin to cock so that by the time they are fully cocked, the club is over the right shoulder with the head end of the club pointed toward the target, the toe of the club is pointed at the ground and the shaft of the club is parallel to the target line and to the ground. As the arms are raised, the left arm must remain relatively straight (but not stiff) while the right arm bends at the elbow and stays close to the right side. The forearms also roll over each other so that the right palm is partially supinated. During all this the head is tilted slightly to the right and remains behind the ball. The chin must be kept high enough to allow the shoulders to be passed under it, and yet the eyes must be kept on the back of the ball. All of this should be done in a slow deliberate movement. Care should be taken that the left heel does not rise off the ground and the weight transferred to the right foot remains more to the inside of the right foot. The result of all this is two-fold. First, the body is wound like a spring and has tremendous stored energy in it. Secondly, the club is in perfect position to begin the downswing and follow through.

Basically the downswing is exactly opposite to the backswing. Everything rotates about a stationary spine, and it is started very slowly. Once again, the ankles and knees start the downswing, the hips turn back to square, the shoulders come back to square, the arms come back to square and the club comes back to square. By the time the golfer gets back to impact position, all of the stored energy in the body at the top of the backswing has been released and the club head is accelerating through the ball hit. The speed is such that it carries the club through the impact position while still accelerating. The club continues to follow through until it wraps around the left shoulder with the hands as high or higher than they were at the top of the backswing.

If executed properly, the golf swing starts slowly on the backswing, travels along the target line for about a foot and then starts to describe an arc inside the target line. Meanwhile, the body weight shifts from being equally distributed on both feet to almost entirely on the right foot. On the downswing, the swing starts slowly once again with the club describing an arc inside the target line, the weight shifting back toward the center, and the club head gathers speed as the stored energy from the wound position of the body begins to be released. About one foot behind the ball, the club squares and remains so travelling down the target line until about six to eight inches after impact. Also at impact, the body weight has shifted to slightly more on the left foot and continues to shift until almost all of the weight is on the left foot at the top of the follow through. The right foot has risen so that it merely aids acceleration through impact ensuring more power. The arms, meanwhile, have returned to address position at impact and the arms have started to roll over each other until the right hand is pronated at the top of the follow through. At impact both arms are straight. After impact, the left arm begins to fold and allows the club to start describing an arc inside the target line once again. The result of all these things being done right is that it results in a relatively low powerful draw with overspin which produces extra roll. In other words, it results in a long straight shot. If all of these things are done correctly the butt end of the golf club remains pointed at the golfer's body or the spine.

Approximately ten years ago the most popular teaching method for the professionals was to ask the golfer to keep the butt end of the club within the so-called power triangle. The so-called "power triangle" is the triangle described by the line of the shoulders and the arms as they hold the club at address position. The exact centre of the triangle is the spine. The spine is directly behind the breastbone. One basic problem with many of the devices described in the above listed patents is that they do not address these facts. Moreover, many existing golf swing aids are unduly complicated and consequently expensive. In the opinion of the inventor, the device coming closest to offering a solution to the problem is that disclosed by the above-mentioned Canadian patent (Austin et al). However, there are several drawbacks to the Austin et al device, including the fact that there are several angles between the elements of the device resulting in a somewhat complicated structure, and there are certain critical limitations on the movement of the elements in the Austin et al device because of the particular joint structures.

GENERAL DESCRIPTION OF THE INVENTION

The objects of the present invention are to provide a device for improving a golf swing which takes into consideration the mechanics of a good swing as described hereinbefore; and to provide such a device in a form which can readily be mass produced from structurally simple elements.

Accordingly, the present invention relates to a golf swing improvement device comprising harness means for mounting on the shoulders of a user, said harness means including first strap means for extending horizontally across the chest of a user in the area of the sternum; multi-sectional, rectilinear, extensible wand means; first universal joint means pivotally interconnecting said first strap means and one end of said wand means at a front central area of the first strap means, whereby the first joint means is located proximate the sternum of the user when the device is in the use position; and second universal joint means for pivotally interconnecting the other end of said wand means to the top end of the shaft of a golf club, whereby an extension of the longitudinal axes of the wand always intersects the body of the user proximate the sternum.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

Figure 1:
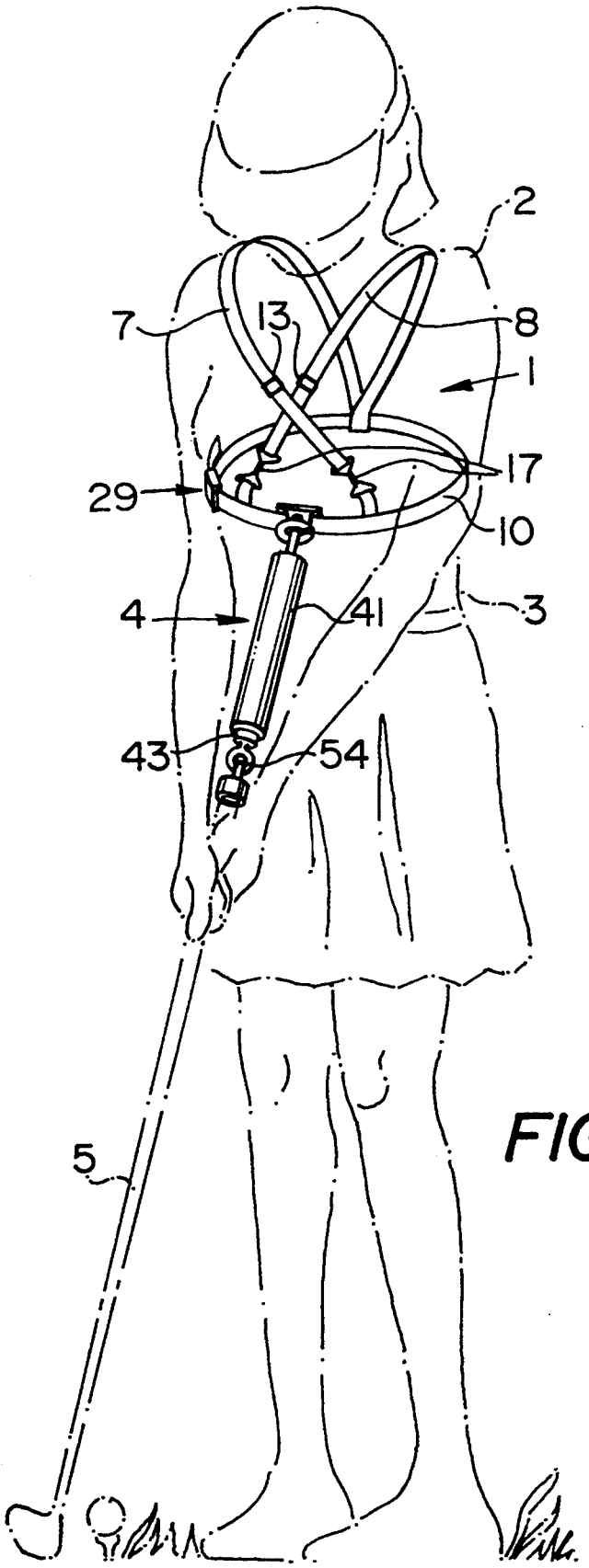
FIG. 1 is a schematic, perspective view of a golf swing improvement device in accordance with the present invention.

With reference to FIG. 1, the basic elements of the device of the present invention include a harness generally indicated at 1 for mounting on shoulders 2 of a user 3, and an extensible wand generally indicated at 4 pivotally connected to the harness 1 for holding a golf club 5.

Figure 2:
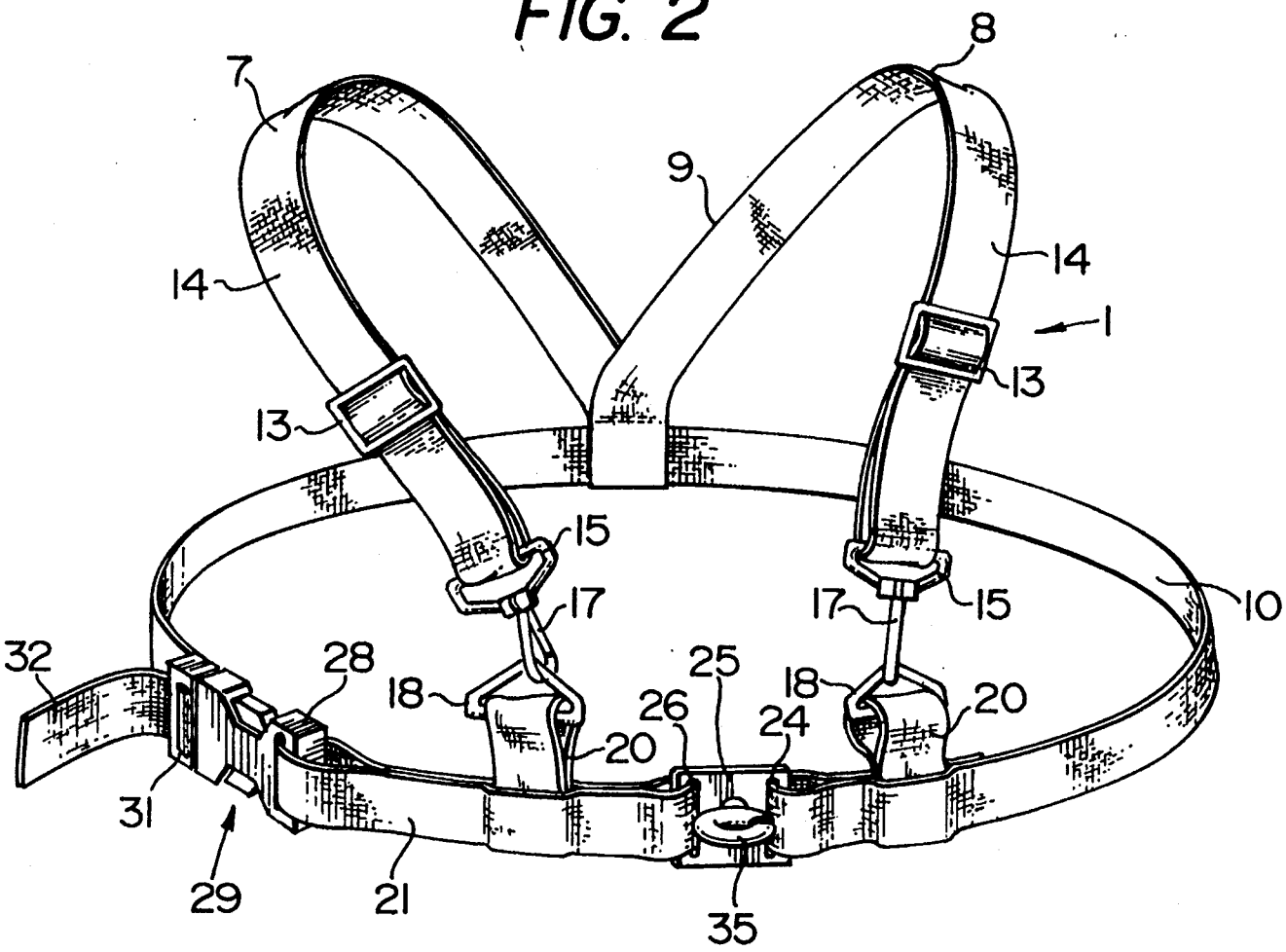
FIG. 2 is a perspective view of the device of FIG. 1 as seen from the front.

As best shown in FIG. 2, the harness 1 includes shoulder straps 7 and 8 defined by a single strip 9 of halter webbing, and a chest strap 10 for extending horizontally around the chest of the user 3 approximately at the level of the sternum. Bar sliders 13 are provided near the front ends 14 of the shoulder straps 7 and 8. The straps 7 and 8 pass through generally triangular, metal retaining rings 15 and are folded over on themselves through the bar sliders 13, so that the length of the straps can be adjusted to suit the user 3. The strip 9 extends around the chest strap 10 in the area of the spine or the center of the user's back and is looped around the strap 10 so that the strap 10 slides freely through the loop at the back of the shoulder strap to allow for varying chest sizes of the user. In the female version of the device, the straps 7 and 8 are crossed in the chest area of the harness, i.e. the straps are designed to pass between the breasts. The male version of the device includes straps 7 and 8 which are parallel in the chest area.

Figure 3:
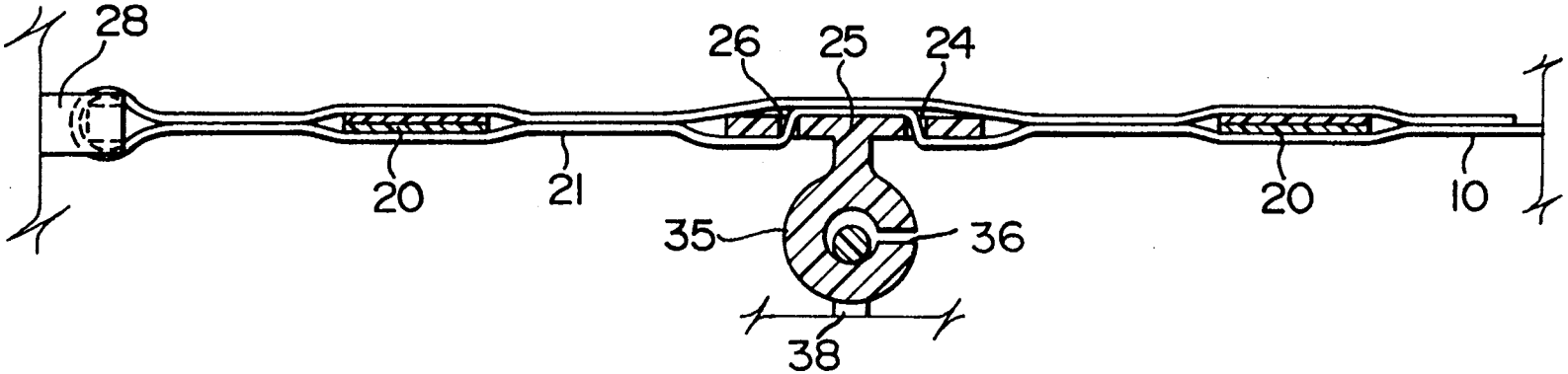
FIG. 3 is a cross-sectional view of the front portion of a chest strap used in the device of FIGS. 1 and 2.

The shoulder straps 7 and 8 are releasably connected to the chest strap 10 by spring clips 17 pivotally mounted on the rings 14, second retaining rings 18 and webbing loops 20. The loops 20 are formed of the same material as the straps 7, 8 and 10, are merely short strips of webbing looped through the rings 18 and sewn between the layers of a double thickness front section 21 of the chest strap 10. Referring to FIG. 3, the front of one end of the strap 10 passes through a slot 24 in one side of the plate 25, around the back of the plate and through a slot 26 in the other side of the plate. Such one end of the strap 10 extends from the plate 25 through one end of the female component 28 of a quick couple, quick release buckle generally indicated at 29. The strap 10 returns behind the loop 20, the plate 25 and the other loop 20. The layers of the front section 21 of the strap 10 are sewn together in the areas between the loops 20 and the plate 25, and between the left-hand loop 20 (as shown in FIG. 2) and the buckle 29. The male component 31 of the buckle 29 is mounted on the other end 32 of the chest strap 10, which is looped through the component 31.

Figure 4:
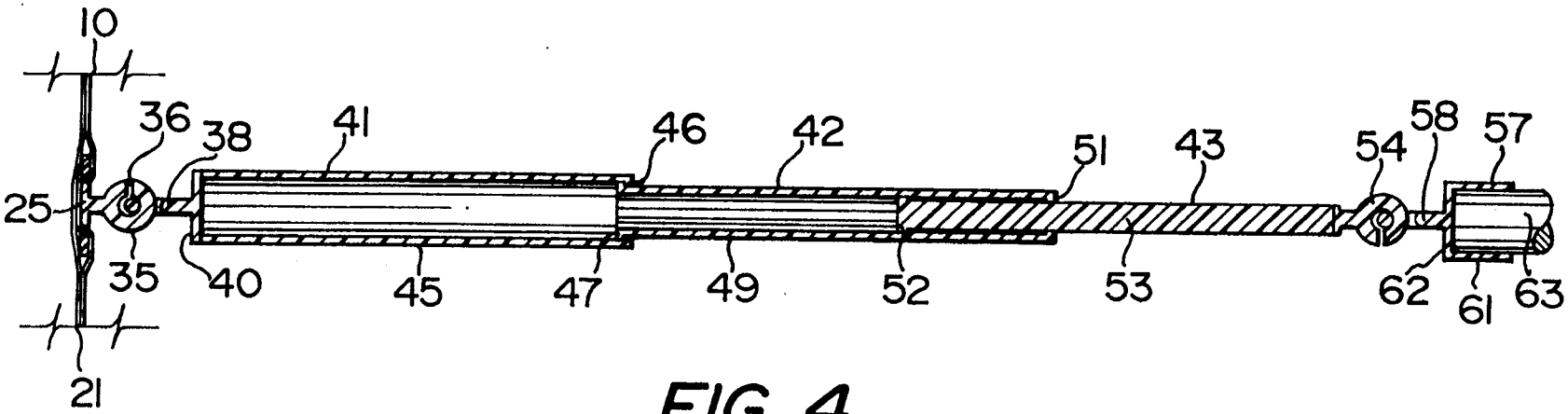
FIG. 4 is a longitudinal sectional view of a wand used in the device of FIGS. 1 and 2.
Figure 5:
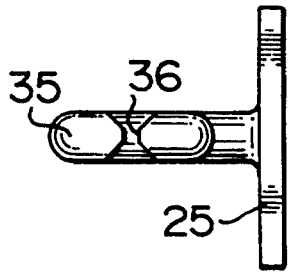
FIG. 5 is a side view of a loop used in the wand of FIG. 4.
Figure 6:
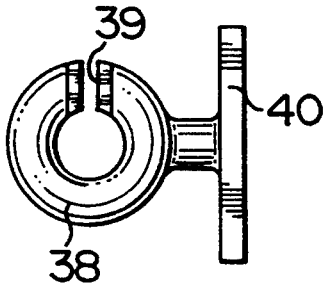
FIG. 6 is a top view of another eyebolt used in the wand of FIG. 4.
Figure 7:
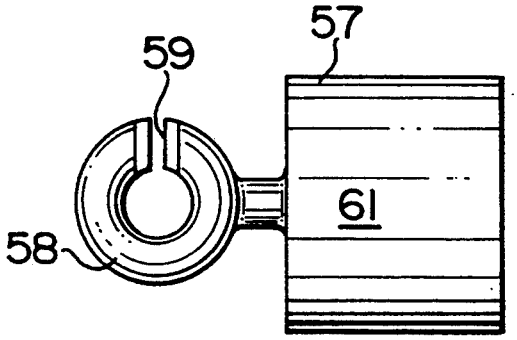
FIG. 7 is a front view of a loop and socket used in the wand of FIG. 4.

As best shown in FIG. 4, the plate 25 carries a loop 35 (FIG. 5) with a slot 36 in one side thereof for facilitating connection to a similar loop 38 (FIG. 6) with a slot 39 therein mounted on a disc 40 at the inner, top end of the wand 4. The loops 35 and 38 define a universal joint between the plate 25 and the disc 40. The disc 40 defines a cap on the uppermost of the three wand sections 41, 42 and 43. The uppermost wand section 41 is defined by a tubular body 45, the upper end of which is closed by the disc 40. An inwardly extending, annular flange 46 is provided on the bottom end of the body 45 for engaging an outwardly extending, annular flange 47 on the upper end of a tubular body 49 defining the middle section 42 of the wand 4. In a similar fashion, an inwardly extending, annular flange 51 on the bottom end of the body 49 engages an annular flange 52 on the upper end of a rod 53 defining the bottom or outer wand section 43. In actual fact, the various flanges retain the wand sections 41, 42 and 43 together when the wand is fully extended. A slotted loop 54 is mounted on the lower end of the rod 53 for pivotally connecting a tubular socket 57 (FIG. 7) to the bottom end of the wand. For such purpose, a similar loop 58 with a slot 59 therein is provided on the top end of the socket 57. The loops 54 and 58 define a second universal joint. The socket 57 is merely a tubular body 61 with a closed top end 62 for receiving the top end of the grip (not shown) on the shaft 63 of the golf club 5.

In use, the harness 1 is placed on the shoulders of the user, and adjusted so that the plate 25 is snugly in position over the sternum. Using the slotted loops, the wand 4 is connected to the plate 25 and the socket 57 is connected to wand. The loops, which function as universal joints, permit the vertical and lateral movement necessary for a good golf swing, while the wand sections 41, 42 and 43 freely rotate around the longitudinal axis of the wand to allow for supination and pronation of the golfer's hands. If the swing is correct, the wand remains within the "power triangle". If the swing is incorrect, the outer end of the wand moves outside of the "power triangle" and contacts one of the arms of the golfer. Depending upon the nature of the swing error, the wand will contact either arm or will contact an arm at a different point during the swing. The major swing faults and the result of such faults are explained in the following.

In the case of a swing involving the arms only or so-called reverse pivot, the wand 4 will contact the left arm on the backswing and the right arm on the follow through high in the swing. When the swing involves the arms only with backward lateral sliding of the golfer, the wand will contact the left arm early in the backswing. When the user's wrists are floppy, contact of the left forearm by the wand is indicative of flopping of the wrists to the right; and contact of the right forearm by the wand is indicative of flopping of the wrists to the left, both occurring early in the backswing. When the golfer goes over the top (past horizontal) during the backswing, the wand will contact the forearm at the top of the backswing. Casting of the club results in contact of the forearm by the wand shortly after initiation of the downswing.

I claim:

1. A golf swing improvement device for use with a golf club having a grip on the top end thereof comprising harness means for mounting on the shoulders of a user, said harness means including first strap means for extending horizontally across the chest of a user in the area of the sternum; multi-sectional, rectilinear, extensible wand means; first universal joint means pivotally interconnecting said first strap means and one end of said wand means at a front central area of the first strap means, whereby the first joint means is located proximate the sternum of the user when the device is in the use position; and second universal joint means for pivotally interconnecting the other end of said wand means to a top end of a grip on the shaft of the golf club, whereby an extension of the longitudinal axis of the wand always intersects the body of the user approximately at the sternum, said second universal joint means including socket means for receiving the top end of the grip of a golf club, whereby the longitudinal axes of the shaft of the golf club, the wand means and the socket means can be aligned with each other and with the sternum of the user at the start of a golf swing.

2. A devise according to claim 1, including second strap means for extending over the shoulders of the user between the center of the first strap means at the back of the user and the front of said first strap means on each side of said first joint means.

3. A device according to claim 2 wherein said second strap means includes a pair of shoulder straps which cross each other in front for use by a female golfer.

4. A device according to claim 2, wherein said second strap means includes a pair of shoulder straps which are parallel to each other in front for use by a male golfer.

5. A device according to claim 2, wherein said wand means includes a first tubular section pivotally connected to said first strap means by said first universal joint means; a second tubular section slidable in the outer end of said first section; and a third section slidable in the outer end of said second section, the outer end of said third section carrying said second universal joint means.

6. A device according to claim 5, including rigid plate means on said first strap means for positioning in the area of a user's sternum, said plate means carrying said first universal joint means.

7. A device according to claim 5, wherein the outer end of each said first and second section includes a first radially inwardly extending, annular flange, and the inner end of each said second and third section includes a second, radially outwardly extending, annular flange, said first and second flanges cooperating to limit outward movement of said second and third sections of the wand means.

8. A device according to claim 1, wherein said first universal joint means includes first loop means on said plate means, and second loop means on said first section of said wand means connected to said first loop means.

9. A device according to claim 8, wherein said second universal joint means includes third loop means on said third section of said wand means, and fourth loop means on said socket means connected to said third loop means.

10. A device according to claim 9, wherein each said loop means is a slotted loop for facilitating assembly and disassembly of the device.

* * * * *